US006026894A

United States Patent [19]

Bachinger

[11] Patent Number: 6,026,894

[45] Date of Patent: Feb. 22, 2000

[54] PLATE-TYPE HEAT EXCHANGER, IN PARTICULAR OIL COOLER

[75] Inventor: Harald Bachinger, Steyr, Austria

[73] Assignee: KTM-Kühler GmbH, Mattighofen, Austria

[21] Appl. No.: 09/140,430

[22] Filed: Aug. 26, 1998

[30] Foreign Application Priority Data

Aug. 27, 1997 [AT] Austria ..... 1441/97

[51] Int. Cl.[7] ..... F28F 3/00

[52] U.S. Cl. ..... 165/166; 165/165; 165/167

[58] Field of Search ..... 165/165, 166, 165/167, DIG. 370

[56] References Cited

U.S. PATENT DOCUMENTS 3,380,517 4/1968 Butt ..... 165/166
4,708,199 11/1987 Yogo et al. ..... 165/167
5,069,276 12/1991 Seidel ..... 165/166
5,078,208 1/1992 Urch ..... 165/166
5,146,980 9/1992 Le Gauyer ..... 165/166
5,469,914 11/1995 Davison et al. ..... 165/166

*Primary Examiner*—Allen Flanigan
*Attorney, Agent, or Firm*—Collard & Roe, PC

[57] ABSTRACT

There is described a plate-type heat exchanger, in particular an oil cooler, comprising a plurality of flow tanks (1) fitted into each other, each formed of a heat exchanger plate (2) with a peripheral shoulder (3), which flow tanks are alternatingly connected with each other via through holes (5, 12) for the heat-exchanging media. To create advantageous constructional conditions it is proposed that the through holes (12) of at least the flow tanks (1) for one of the heat-exchanging media should lie in the vicinity of the shoulders (3) and be connected with each other by at least one connecting box (9) for the supply and discharge lines (10 and 11) of the medium, which is externally connected to the shoulders (3) of the flow tanks (1) fitted into each other.

4 Claims, 2 Drawing Sheets

PLATE-TYPE HEAT EXCHANGER, IN PARTICULAR OIL COOLER

This invention relates to a plate-type heat exchanger, in particular an oil cooler, comprising a plurality of flow tanks fitted into each other and each formed of a heat exchanger plate with peripheral shoulder, which are alternatingly connected with each other via through holes for the heat-exchanging media.

Known plate-type heat exchangers of this type (U.S. Pat. No. 4,708,199 A) have the advantage of a simple design, because between the bottom surfaces acting as heat exchanger plates of the flow tanks fitted into each other and connected with each other in a liquid-tight way there are alternatingly formed flow passages for the two heat-exchanging media, such as oil and water. The heat-exchanging media are passed from the one flow tank through the directly adjoining one into the next flow tank but one, namely via deep-drawn projections of the bottom surfaces of the tanks. The two media can thus each flow from one of their flow tanks through the deep-drawn projection of the adjoining flow tank for the respectively other medium into the next flow tank but one. By means of turbulence sheets inserted into the individual flow tanks a corresponding division of the flow inside the flow tanks can be effected.

To prevent the heat-exchanging media from mixing, a media-tight flow passage through the flow tanks must be achieved for the respectively other medium, which requires a correspondingly tight connection of the deep-drawn projections of the bottom surfaces of the tanks with the adjoining flow tanks. Since for both heat-exchanging media passages through the flow tanks for the respectively other medium must be provided, both for supplying and for discharging purposes, a plurality of connections must be made in a media-tight way, which increases the risk of a leakage and thus a mixing of media. In addition, the plurality of the deep-drawn projections in the bottom surfaces of the tanks reduces the effective heat-exchanging surface of the heat exchanger plates. Finally, the supply and discharge lines of the heat-exchanging media, which are vertical to the flow tanks, not only lead to a larger flow resistance because of the flow deflections required in the vicinity of each tank, but also restrict the installation possibilities depending on the location of the supply and discharge lines of the heat-exchanging media, in particular for oil coolers used in vehicle construction.

It is therefore the object underlying the invention to create a plate-type heat exchanger as described above with simple constructive means such that the risk of a mixing of media is reduced, the efficiency is improved and a wide variety of possible installations can be achieved.

This object is solved by the invention in that the through holes of at least the flow tanks for one of the heat-exchanging media lie in the vicinity of the shoulders and are connected with each other by at least one connecting box for the supply and discharge lines of the medium, which is externally connected to the shoulders of the flow tanks fitted into each other.

Since as a result of these measures the deep-drawn projections otherwise required for the flow passage through the flow tanks can be omitted for at least one of the two heat-exchanging media, because this medium is supplied and discharged from the outside via the through holes in the vicinity of the shoulders, the number of media-tight connections between the deep-drawn projections of the bottom surfaces of the tanks and the adjoining flow tank is at least reduced to the half, so that the risk of a leaky junction is reduced correspondingly. The omission of the deep-drawn projections at least for one of the heat-exchanging media in addition involves an increase of the effective heat-exchanging surface of the heat exchanger plates formed by the bottom surfaces of the tanks, so that on the whole favorable constructional conditions are obtained, all the more so as due to the parallel flow of media through the associated flow tanks the flow resistances between the connecting boxes for the supply and discharge of the medium are reduced. The connection of the connecting boxes to the outside of the shoulders of the flow tanks fitted into each other should of course also be effected in a media-tight way. To this end, a soldered or welded joint may be provided as usual. A leaky point in the vicinity of such box connection can, however, only lead to a discharge of the medium, but not to a mixing of the media. It need probably not be emphasized that when supplying and discharging both heat-exchanging media via through holes in the vicinity of the shoulders of the flow tanks all flow connections extending through the flow tanks via deep-drawn projections can be omitted, which provides particularly favorably constructional conditions.

The flow path inside the flow tanks connected with connecting boxes for the supply and discharge of a medium can also be determined by the local allocation of the connecting boxes. When the connecting boxes for the supply and discharge of a medium are for instance provided on opposite sides of the flow tanks, the medium will substantially flow from the one side of the flow tanks to the opposite side. But when the connecting boxes for the supply and discharge of a medium are formed by a common housing divided into two chambers by means of a partition, which housing is connected at one side of the flow tanks, a circulating flow of the medium inside the flow tanks can be enforced, in particular when the flow tanks connected with each other by means of the housing have a guiding means for the flow of media disposed in continuation of the partition of the housing. This guiding means disposed in continuation of the partition of the housing prevents a flow short-circuit between the housing chambers for the supply and discharge of the medium, which are connected to the flow tanks in parallel beside each other.

In the drawing, the subject-matter of the invention is represented by way of example, wherein.

Figure 1:
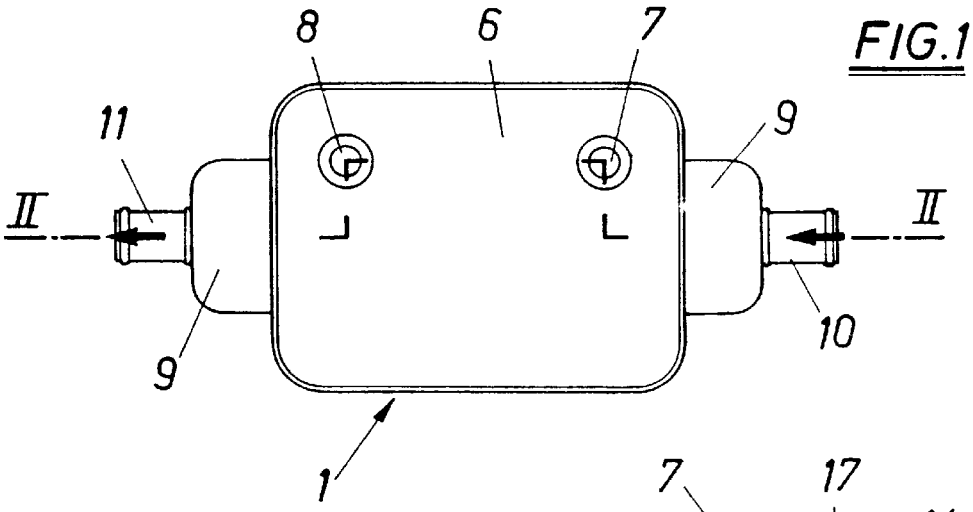
FIG. 1 represents a top view of an inventive plate-type heat exchanger.
Figure 2:
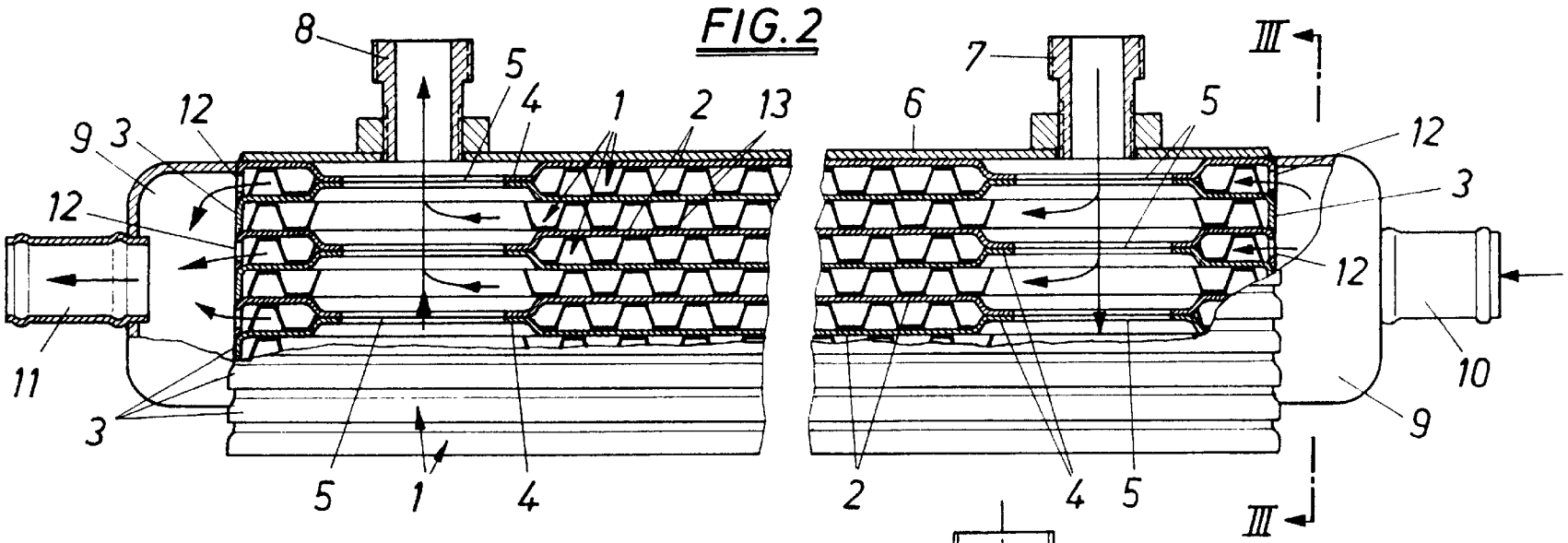
FIG. 2 represents this plate-type heat exchanger in a section along line II—II of FIG. 1 on an enlarged scale.
Figure 3:
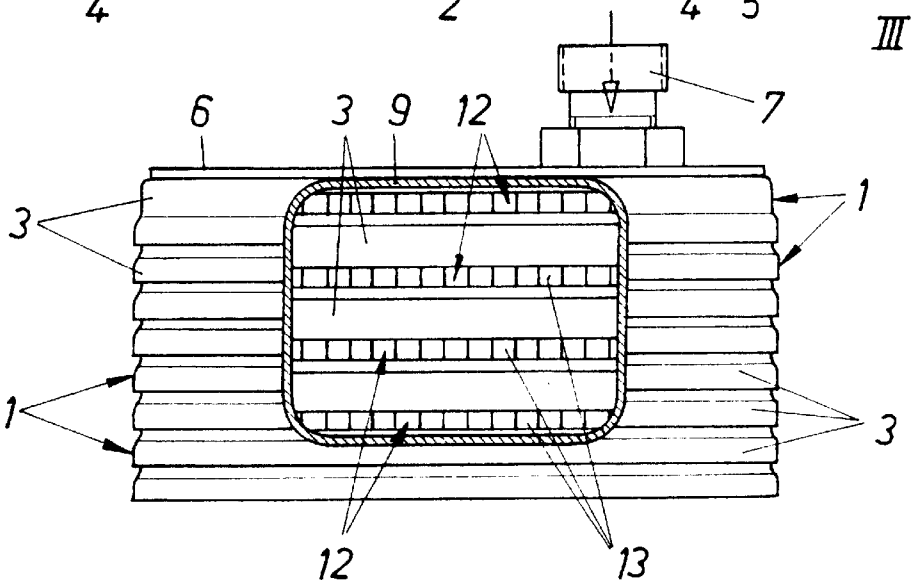
FIG. 3 shows a section along line III—III of FIG. 2.

The plate-type heat exchanger in accordance with FIGS. 1 to 3 consists of individual flow tanks 1 fitted into each other, which are each formed of a heat exchanger plate 2 with a raised peripheral shoulder 3, which heat exchanger plate constitutes the bottom surface of the tank. The flow tanks 1 are provided with deep-drawn projections 4 alternatingly protruding against each other, which have through holes 5. Since the projections 4 lying flat against each other in the vicinity of the end face are connected with each other in a liquid-tight way, the projections 4 each provide for liquid-tight passages through the second flow tank 1, as can be taken from FIG. 2. The uppermost flow tank 1 is covered with a cover plate 6, which has a connection 7 for supplying and a connection 8 for discharging one of the two heat-exchanging media, for instance oil. The oil to be cooled, which is supplied via the connection 7, therefore flows through every second flow tank 1 of the stack of tanks constituting the plate-type heat exchanger, so as to be withdrawn via the connection 8 in the cooled condition. The cooling medium, e.g. water, flows through the flow tanks 1, which are disposed between the flow tanks 1 for the oil flow. In contrast to the oil flow, however, the water is guided by means of connecting boxes 9 for a supply line 10 and a discharge line 11, which are externally connected to the shoulders 3, where the connection between the connecting boxes 9 and the flow tanks 1 for the water flow is effected by means of through holes 12 in the vicinity of the shoulders 3. The through holes 12 can easily be formed by corresponding slotted recesses of the shoulders 3. It is, however, also possible to bend up the shoulders 3 in the vicinity of the through holes 12, between indentations provided at the edge, so as to obtain the through holes 12. The water pumped through the supply line 10 into the connecting box 9 used as distributor flows through the through holes 12 into the flow tanks 1 and on the opposite side of the tank is discharged through holes 12 into the connecting box 9 used as collector, from where it is discharged via the discharge line 11. In accordance with the illustrated embodiment, the oil is countercurrently cooled with the cooling water. The flow distribution inside the flow tanks 1 can be influenced in the known manner by guiding means, for instance by turbulence sheets 13.

Figure 4:
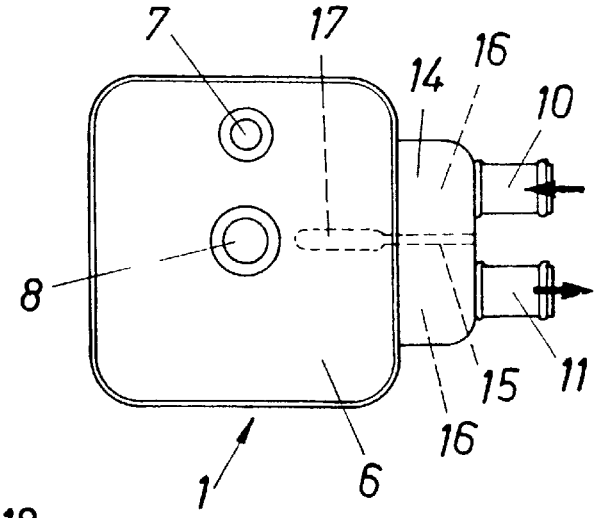
FIG. 4 shows a representation of a constructional variant of an inventive plate-type heat exchanger corresponding to FIG. 1.

The plate-type heat exchanger in accordance with the embodiment shown in FIG. 4 has a common housing 14 for the supply line 10 and the discharge line 11 of the cooling medium, where a partition 15 divides the housing into two chambers 16 constituting the connecting boxes. This housing 14 is mounted on an outer surface of the plate-type heat exchanger, which like the plate-type heat exchanger shown in FIGS. 1 to 3 consists of flow tanks 1 fitted into each other. To enforce a circulating flow inside the flow tanks 1 for the cooling medium, guiding means 17 may be provided inside the flow tanks 1 in continuation of the partition 15. The oil supply is again effected transverse to the flow tanks 1 via connections 7 and 8 for the supply and discharge lines.

Figure 5:
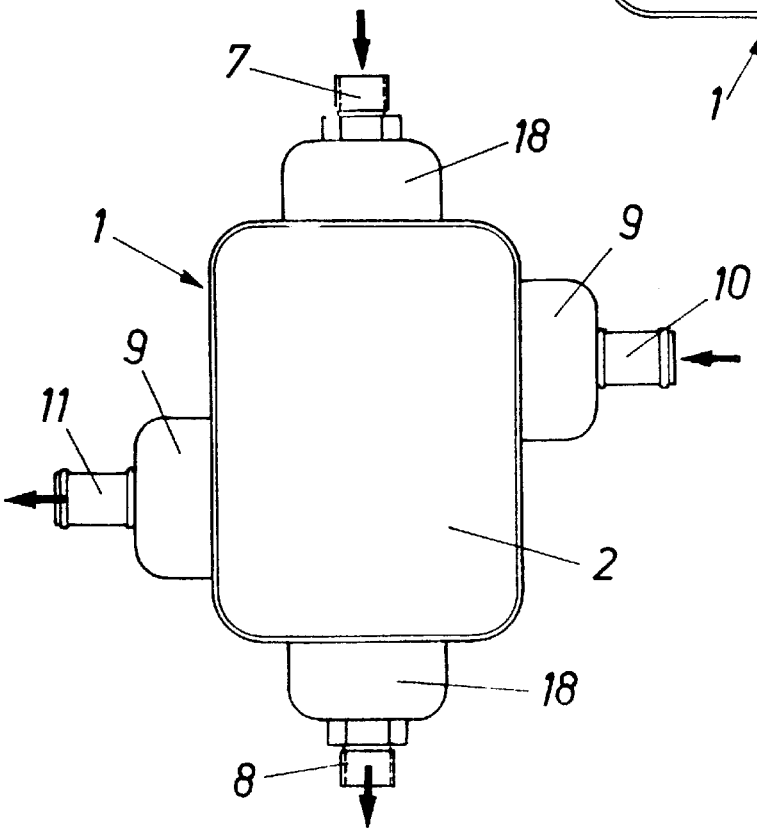
FIG. 5 shows a further embodiment of an inventive plate-type heat exchanger in a simplified top view.

As shown in FIG. 5, not only the cooling medium is supplied to the flow tanks 1 via connecting boxes 9 for the supply and discharge lines 10, 11, but also the oil to be cooled. The connecting boxes 18 with the connection 7 for supplying and the connection 8 for discharging the oil are disposed on the oppositely located end faces of the plate-type heat exchanger, while the connecting boxes 9 for the cooling medium are disposed on the oppositely located side faces of the plate-type heat exchanger, namely offset with respect to each other. The connecting boxes 9 and 18 are each connected with the flow tanks 1 via through holes in the vicinity of the shoulders 3 of the flow tanks 1, so that the flow of media is not impeded by deep-drawn projections. Therefore, the bottom surfaces of the tanks do not constitute heat exchanger plates 2 interrupted by such deep-drawn projections.

The invention is of course not restricted to the illustrated embodiments, which already show, however, that the mutual arrangement of the connecting boxes for the supply and discharge lines 10, 11 of the one of the two heat-exchanging media as well as the connections 7 and 8 for supplying and discharging the respectively other medium can be varied in many ways corresponding to the respective conditions. Since in addition the layout of the flow tanks 1 can largely freely be chosen, it is easily possible to provide plate-type heat exchangers for very different space requirements and with an advantageous efficiency, as on the one hand the flow resistances can be reduced and on the other hand the heat exchanger surfaces provided by the layout of the flow tanks can be utilized more efficiently.

I claim:

1. A plate-type heat exchanger, in particular an oil cooler, comprising a plurality of flow tanks (1) fitted into each other and each formed of a heat exchanger plate (2) with a peripheral shoulder (3), which flow tanks are alternatingly connected with each other via through holes (5, 12) for the heat-exchanging media, characterized in that the through holes (12) of at least the flow tanks (1) for one of the heat-exchanging media lie in the vicinity of the shoulders (3) and are connected with each other by means of at least one connecting box (9) for the supply and discharge lines (10 and 11) of the medium, which is externally connected to the shoulders (3) of the flow tanks (1) fitted into each other.

2. The plate-type heat exchanger as claimed in claim 1, characterized in that the connecting boxes (9) for the supply and discharge lines (10, 11) of a medium are provided on opposite sides of the flow tanks (1).

3. The plate-type heat exchanger as claimed in claim 1, characterized in that the connecting boxes (9) for the supply and discharge lines (10, 11) of a medium consist of a common housing (14) divided into two chambers (16) by a partition (15).

4. The plate-type heat exchanger as claimed in claim 3, characterized in that the flow tanks (1) connected with each other by means of the housing (14) have a guiding means (17) for the flow of media disposed in continuation of the partition (15) of the housing (14).

* * * * *